United States Patent [19]

Koppensteiner

[11] Patent Number: 4,538,706

[45] Date of Patent: Sep. 3, 1985

[54] PROGRESSIVE SAFETY

[75] Inventor: Werner Koppensteiner, Vienna, Austria

[73] Assignee: Otis Elevator Company, Farmington, Conn.

[21] Appl. No.: 503,943

[22] Filed: Jun. 13, 1983

[30] Foreign Application Priority Data

Mar. 21, 1983 [AT] Austria ..... 989/83

[51] Int. Cl.[3] ..... B66B 5/18

[52] U.S. Cl. ..... 187/90; 187/83; 188/41

[58] Field of Search ..... 187/73, 83, 84, 86, 187/88, 89, 90; 188/41, 42, 43, 44, 65.1, 67

[56] References Cited

U.S. PATENT DOCUMENTS 1,581,458 4/1926 Lindquist ..... 187/67
1,873,829 8/1932 Dunlop ..... 187/89
4,083,432 4/1978 Lusti ..... 187/89
4,469,198 9/1984 Crump ..... 187/88 X

FOREIGN PATENT DOCUMENTS 1953867 11/1968 Austria ..... 187/90

*Primary Examiner*—Joseph J. Rolla
*Assistant Examiner*—Nils E. Pedersen
*Attorney, Agent, or Firm*—Robert E. Greenstein

[57] ABSTRACT

A safety device for stopping an elevator car or counterweight has a brake shoe on one side of a guide rail, and, on the other side, two leaf springs and a roller. The springs define a tapered area, and the roller is pulled by a governor to engage the rail, which trips the roller, causing it to be forced into the tapered area and forcing the brake shoe against the rail. The roller engages a soft metal stop when the device is operated and this stop is worn away during each operation, which permits the roller to move higher on each operation; this compensates for any wear on the brake shoe. The governor is attached to the car or counterweight.

2 Claims, 4 Drawing Figures

FIG. 1
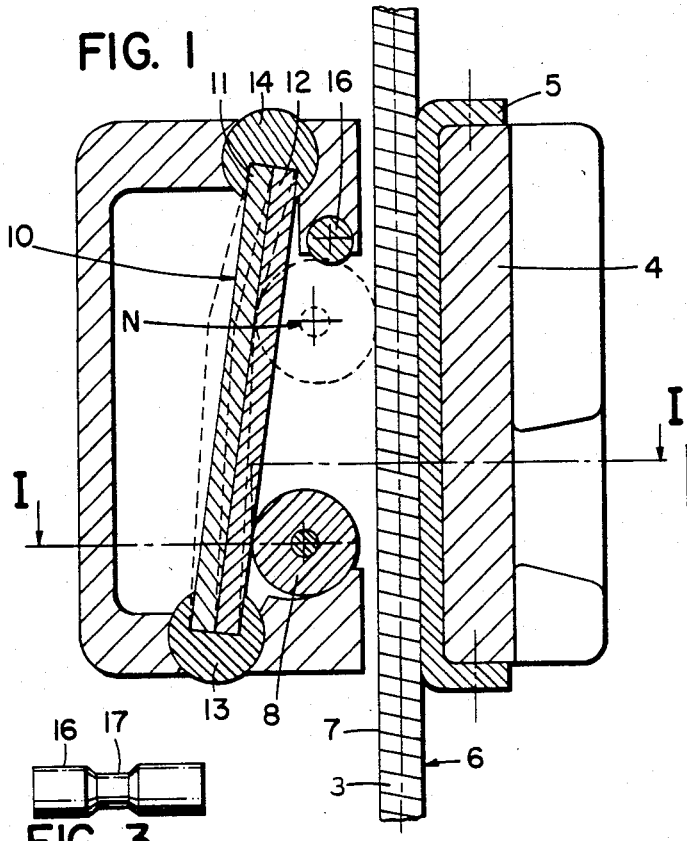
FIG. 3
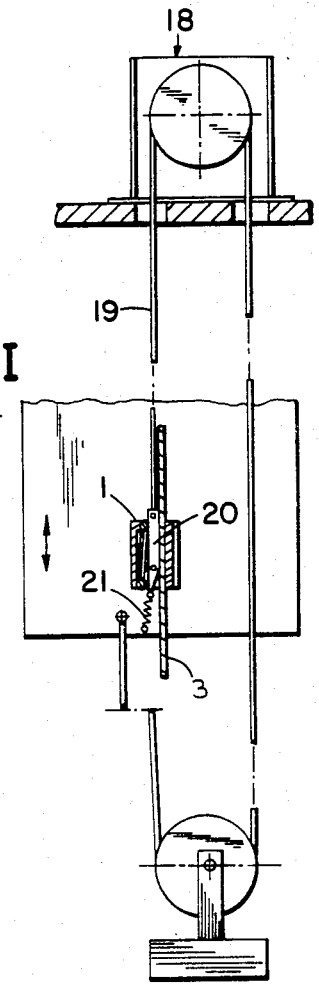
FIG. 4
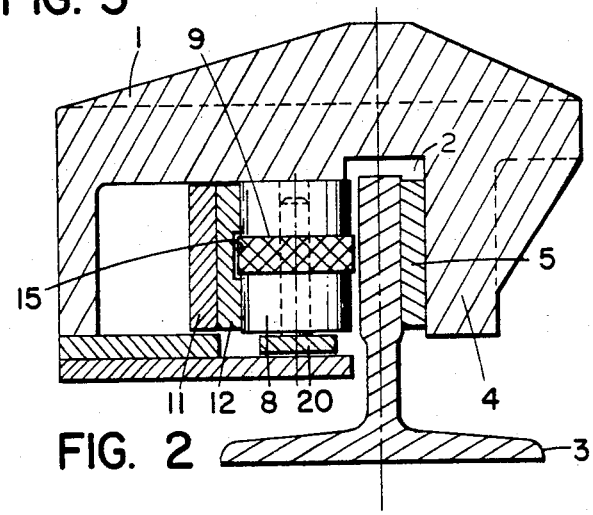
FIG. 2

PROGRESSIVE SAFETY

DESCRIPTION

1. Technical Field

This invention relates to elevators, specifically, elevator safety devices.

2. Background Art

Safety regulations concerning the design of elevators require a progressive safety on the elevator car or its counterweight. The safety is designed so that, if the elevator is operated at or above certain speeds, e.g., 0.8 meters per second, the car or counterweight will be decelerated at a fast, but comfortable rate when the car or counterweight is moving at a maximum or critical speed. Typically, that deceleration is 10 meters per second$^2$, lasting for a short period of time, usually about 40 ms. A maximum deceleration, about 25 meters per second$^2$, is permissible.

The progressive safety, one of several types of safety known in the prior art, provides deceleration that increases with distance, and is usually complex and expensive. Usually, there is an entire safety block (assembly) that consists of a resilient member, such as a prestressed spring coil and a braking surface that is forced against the guide rail by a rather complex array of levers and wedges operating on the resilient member. Other similarly operating safeties use disks, springs and eccentric members to force the brake surface against the rails. This type of safety device presents several disadvantages, in addition to being extremely expensive. Among them, the safeties are difficult to maintain, (often requiring lubrication of the various moving parts they contain to operate the brake), and the brake forces decrease gradually as the linings wear, e.g., after test stops are made, which is a major problem with existing safeties.

A progressive safety is shown in German published application No. 2604157. That safety has a pivoted wedge that guides a safety gear, and a set of disk springs pushes on the guiding wedge. The guide wedge needs a special mounting arrangement, however, and the springs, because of their special shape, need a special mount, which takes up significant space. The safety roller also wears on only one side, and the springs require a critical adjustment for the safety to operate properly.

DISCLOSURE OF INVENTION

An object of the present invention is to provide a structurally simple, compact, inexpensive progressive safety that needs nearly no maintenance and whose brake force does not deteriorate rapidly.

According to the present invention, an elevator safety (for the car or counterweight), has a brake shoe that is located on one side of the guide rail. On the opposite side of this rail is a roller and a spring (e.g., a pivoting leaf spring), which defines, on one side of the rail, a tapered area (an area wider at one end). The roller is normally at an at-rest position in the wider end. When the elevator enters an overspeed condition, this roller is pulled upward (e.g., by a governor) forcing the roller between the spring and the rail. As a result of movement of the safety roller in that one direction, the roller is continually pushed up against the spring towards (in the opposite direction) the narrower end of the area. The brake pad (on the other side of the rail) is pulled tighter and tighter against the rail, as this happens, producing a progressively increasing deceleration force that is limited by the pressure applied by the leaf spring. The actuating roller engages a soft material stop, which is at the narrow end of the area, and this stop is worn slightly, by the roller, during operation of the safety. This wear serves to compensate for any wear in the roller, but, in particular, in the brake pad, by allowing the roller to locate somwhat higher in the narrow area between the spring and the rail.

BRIEF DESCRIPTION OF THE DRAWINGS

FIG. 1 is an elevational view of a progressive safety embodying the present invention;

FIG. 2 is a plan view along the line I in FIG. 1;

FIG. 3 is a plan view of the roller; and

FIG. 4 is a diagrammatic elevational view of an elevator safety system employing a governor to operate a safety embodying the present invention.

BEST MODE FOR CARRYING OUT THE INVENTION

In the progressive safety shown in FIGS. 1 and 2, a housing frame 1 is configured like tongs, with a channel-like portion 2. This housing surrounds, so to speak, a guide rail 3, e.g., for elevator car or the counterweight in elevator system. Within this housing is a brake shoe 4 with a brake lining 5, e.g., made of brass. The brake lining 5 is positioned to engage (slide on) one surface 6 of the rail 3. A "free" safety roller (safety actuator gear) 8 is located in the portion 2, but next to the other (the opposite) rail surface, surface 7. The safety guide roller has a collar-like portion 9, a circular raised area on the roller. The roller 8 is actually disposed in the portion 2 between the surface 7 and a leaf spring 10, which is also in the portion 2, and which in this embodiment comprises two individual leaf springs 11, 12. One spring 12, the one facing the rail, contains a slot that receives the collar 9, which may be roughened to improve its traction on the rail. The springs are pivotally attached by circular end pieces on pivot mounts 13 and 14. As a result of this mounting arrangement, the springs can flex in and out within the housing (under pressure of the roller 8, as explained below). This spring motion is shown in FIG. 1 by the dotted lines, which show their "moved" positions. These springs, as arranged, define a profiled or tapered portion, defining a tapered area (shaped like a trapezoid) in which the roller 8 moves. At the upper end of this tapered area (at the narrowest portion) is a brass stop 16 in the housing, which contains a recessed portion 17, giving the stop a spool-like shape. The stop 16 is engaged by the roller 8 and the collar portion 9 rests in the narrowed portion 17 when this happens.

The safety device operates in the following manner, which is explained in conjunction with the diagrammatic view shown in FIG. 4, which shows a governor operated safety arrangement in a simplified elevator. When the descending counterweight assumes an excessive velocity (for any reason whatsoever), a speed governor 18 operates, and through a governor rope 19 and a safety gear linkage 20, trips the safety guide roller, lifting the safety guide roller 8 up against the spring 21 (see FIG. 2). The roller is then drawn progressively further and further into the tapered area between the spring and the surface 7, because the collar contacts the rail and rolls upward towards the narrow end of the tapered area. As a result, the leaf springs are deflected away from the rail by the upward motion of the rail as this happens. Ultimately, the roller moves high enough in the tapered area to engage the stop 16, all the time rotating. At that point, it bites slightly into the recessed portion 16, cutting away part of the stop. The brake shoe is progressively forced harder and harder against the rail surface during this rapidly occurring sequence, and thereby applies a braking force on the rail, that force increases progressively as the roller moves towards the stop. While this happens, the car and counterweight are smoothly slowed from the overspeed condition.

The rail and the roller and the springs are made of hardened steel, though the roller may be hardened only at its surface, so that the roller's surface, namely, the collar 9, does not wear substantially during test operations of the safety. Every operation of the safety, it must be emphasized, will produce some wear in the brake lining, but this wear is compensated by the wear in brass stop 16; it allows the roller to move higher and higher during each stop, which provides "dimensional compensation", so to speak, for the reduction in the thickness of the brake lining.

Once the safety is actuated, the roller is wedged very tightly in the upper portion of the tapered area. But, it can be reset very easily. The safety housing simply is raised slightly (e.g., by raising the car), an operation which causes the safety roller to roll in the opposite direction (down). Ultimately, the roller is manually reset within the housing frame at its "free" position at the bottom. The roller is very loose in this initial or reset position, and the benefit from this is that contact between the roller and the rail during normal elevator operation is avoided, which prevents inadvertent safety operation, e.g., from vibration.

The foregoing will suggest, to one skilled in the art, modifications, variations and alterations in the foregoing embodiment without departing from the true scope and spirit of the invention.

I claim:

1. A progressive safety device in an elevator having a governor that has a cable extending to a car and that pulls on the cable when at certain car speeds and accelerations for braking an elevator car or counterweight characterized by:

a housing, said housing being attached to the elevator car or the counterweight and adapted for receiving a guide rail;

a brake shoe, said shoe being attached to the housing and located on one side of the rail;

a spring assembly, said assembly being attached to the housing and defining a tapered area on a second side of the rail opposite said one side;

a roller, said roller being located within said tapered area and adapted to be connected to a governor connected to the car or counterweight for being directed initially towards the narrow end of said area by the governor cable to engage the rail and thereupon be forced progressively further in the narrow end by rolling on the rail as the car or counterweight moves; and a soft metal stop that is located in the housing in said narrow portion of said tapered area, said stop being in a position therein to be engaged by said roller and made of softer metal than the roller so that wear on the stop compensates for wear in the brake shoe.

2. A progressive safety device in an elevator having a governor that has a cable extending to a car and that pulls on the cable when at certain car speeds and accelerations for braking an elevator car or counterweight characterized by:

a housing, said housing being attached to the elevator car or the counterweight and adapted for receiving a guide rail;

a brake shoe, said shoe being attached to the housing and located on one side of the rail;

a spring assembly, said assembly being attached to the housing and defining a tapered area on a second side of the rail opposite said one side;

a roller, said roller being located within said tapered area and adapted to be connected to a governor connected to the car or counterweight for being directed initially towards the narrow end of said area by the governor cable to engage the rail and thereupon be forced progressively further in the narrow end by rolling on the rail as the car or counterweight moves;

said roller contains a collar portion, said portion being roughened and engaging the rail when said roller is pulled upward towards said narrow portion; and said spring assembly comprises two or more leaf springs and one spring contains a slot for receiving said collar portion to guide said roller in the tapered area.

* * * * *